United States Patent [19]

Ostroski et al.

[11] 4,441,602

[45] Apr. 10, 1984

[54] ELECTRONIC COIN VERIFICATION MECHANISM

[76] Inventors: Joseph Ostroski, 3413 W. Aster, Phoenix, Ariz. 85029; Lawrence M. Briski, 2510 W. Palo Verde Dr., Phoenix, Ariz. 85017

[21] Appl. No.: 326,573

[22] Filed: Dec. 2, 1981

[51] Int. Cl.[3] ..... G07D 5/08

[52] U.S. Cl. ..... 194/100 A

[58] Field of Search ..... 194/97 R, 100 R, 100 A; 73/163

[56] References Cited

U.S. PATENT DOCUMENTS

| | | | |
|---|---|---|---|
| 2,589,214 | 3/1952 | Andrews | 194/100 |
| 3,059,749 | 10/1962 | Zinke | 194/100 |
| 3,401,780 | 9/1968 | Jullien-Davin | 194/100 R |
| 3,599,771 | 8/1971 | Hinterstocker | 194/100 A |
| 3,741,363 | 6/1973 | Hinterstocker | 194/100 A |
| 3,869,663 | 3/1975 | Tschierse | 194/100 A X |
| 3,901,368 | 8/1975 | Klinger | 194/100 A |
| 3,984,307 | 10/1976 | Kamentsky et al. | 209/579 X |
| 4,108,296 | 8/1978 | Hayashi et al. | 194/100 A X |
| 4,124,110 | 11/1978 | Hovorka | 194/100 A |
| 4,257,512 | 3/1981 | Hooker | 194/100 A |

*Primary Examiner*—F. J. Bartuska

*Attorney, Agent, or Firm*—Cahill, Sutton & Thomas

[57] ABSTRACT

An electronic coin verification mechanism includes first and second drive coils driven by complementary sinusoidal signals provided by an oscillator. First and second sense coils are disposed opposite the first and second drive coils and are inductively coupled thereto. A reference coin is removably retained between the first drive coil and first sense coil while a coin under test is guided along a predetermined path which passes between the second drive coil and second sense coil. A comparator coupled to the first and second sense coils compares the voltages inductively coupled thereto and generates an output signal when such inductively coupled voltages substantially equal one another for indicating that the coin under test matches the reference coin. The first and second drive coils and first and second sense coils are each planar and are advantageously provided by forming the same as spiral patterns of metal upon printed circuit boards.

2 Claims, 6 Drawing Figures

ELECTRONIC COIN VERIFICATION MECHANISM

BACKGROUND OF THE INVENTION

1. Field of the Invention

The present invention relates generally to apparatus for detecting the authenticity of a coin, and more particularly, to a compact and inexpensive electronic coin verification apparatus which electronically compares a coin under test to a reference coin.

2. Description of the Prior Art

Vending machines and other coin operated mechanisms typically include an apparatus for analyzing coins inserted within such machines for the purpose of determining whether such coins are authentic and of the proper monetary value to actuate the machine. Mechanical coin verification apparatus is known in the art wherein the size and/or weight of inserted coins are mechanically determined to detect counterfeit coins or coins of the wrong monetary value. Often, such mechanical apparatus includes a magnet for attracting ferrous metal slugs and thereby preventing such slugs from actuating the machine. However, such mechanical coin verification apparatus is subject to numerous disadvantages, including jamming due to bent coins, slow coin feed rates, relatively large size, relatively great expense, and difficulty in altering such apparatus to detect coins of a different value.

Electronic coin detection apparatus is also known to the art. In one type of such electronic coin verification apparatus, the coin under test is used to modulate the frequency of a first oscillator, the output frequency of which is then compared to the output frequency of a second reference oscillator. However, coin verification apparatus of this type is sensitive to changes in temperature and supply voltage, since such changes often affect the first and second oscillators to a different extent. Accordingly, frequent adjustments are typically required to maintain such coin verification apparatus in working order. Moreover, alteration of such apparatus to detect coins of different values requires either replacement of components or substantial adjustments to the reference oscillator. In addition, coin verification apparatus of this type is generally bulky and expensive.

A second type of electronic coin verification apparatus is also known in the art wherein a reference coin, of the type to be detected by the coin verification apparatus, is stored within such apparatus, and a comparison is made electronically between a coin under test and the stored reference coin. For example, in U.S. Pat. No. 2,589,214, an electrical coin selector is disclosed wherein a standard coin lies adjacent a first winding of an E-shaped iron core, while the coin under test is temporarily held against a second winding thereof. A third central winding of the iron core has a voltage induced therein through inductive coupling between it and the first and second windings of the E-shaped core. A null voltage across the third winding indicates a balanced condition wherein the standard coin and coin under test have the same characteristics. Similarly, in U.S. Pat. No. 3,059,749, a coin testing apparatus is disclosed wherein a detector bridge circuit includes a pair of coil form inductors, one of which surrounds a standard coin while the other surrounds a slot through which a test coin is guided. The bridge circuit includes a pair of output terminals which are balanced or nulled when the coin under test matches the standard coin. Trimmer capacitors are provided within the bridge circuit to provide for adjustment of the bridge circuit to provide a null output signal during balanced conditions.

However, prior art coin verification apparatus utilizing a standard or reference coin is relatively bulky and expensive, prohibiting its use in such applications as table-top electronic games and other compact, cost-sensitive equipment.

Accordingly, it is an object of the present invention to provide an electronic coin verification apparatus adapted to accept coins at a relatively rapid feed rate.

It is another object of the present invention to provide an electronic coin verification apparatus which is extremely compact and of inexpensive construction.

It is still another object of the present invention to provide an electronic coin verification apparatus which is relatively immune to changes in temperature and supply voltage.

It is a further object of the present invention to provide an electronic coin verification apparatus wherein the type of coin which the apparatus is to detect may be easily and conveniently altered.

These and other objects of the present invention will become more apparent to those skilled in the art as the description thereof proceeds.

SUMMARY OF THE INVENTION

Briefly described, and in accordance with one embodiment thereof, the present invention relates to an electronic coin verification apparatus which releasably retains a reference coin and which guides a coin under test along a predetermined path; first and second matched drive coils are disposed adjacent to the reference coin and adjacent to the predetermined path along which the coin under test is guided, respectively. A first sense coil is disposed adjacent to the reference coin on a side thereof opposite the first drive coil, and a second sense coil matched to the first sense coil is disposed adjacent to the predetermined path along which the coin under test is guided on a side thereof opposite the second drive coil. An oscillator is coupled to the first and second drive coils for applying thereto first and second generally sinusoidal voltages, respectively, equal to one another in magnitude. A comparator compares the voltages inductively coupled into the first and second sense coils and generates an output signal when such inductively coupled voltages are substantially equal, thereby indicating that the coin under test matches the reference coin and is, in fact, authentic.

In the preferred embodiment of the present invention, the coin under test moves along the predetermined path under the force of gravity in a substantially continuous motion, allowing the apparatus to accept coins under test virtually as fast as they can be fed into the apparatus. The apparatus may advantageously be maintained compact and inexpensive by utilizing a pair of parallel panels spaced apart from one another by a distance slightly in excess of the thickness of the thickest coin which one might desire to authenticate. Reference coin retaining members extend between the pair of panels to form a pocket for releasably retaining the reference coin at a predetermined position between the first drive coil and first sense coil. Test coin ramp members also extend between the pair of panels to form a guide ramp which causes a coin under test to pass precisely between the second drive coil and second sense coil as the coin under test falls along the predetermined path.

To further reduce the expense and size of the coin verification apparatus, the first drive coil and first sense coil are preferably planar and are disposed parallel to one another and parallel to the faces of the reference coin; similarly, the second drive coil and second sense coil are also planar and are disposed parallel to one another and parallel to the faces of a coin under test passing therebetween. The first and second drive coils may advantageously be formed as matched spiral patterns of metal on a first printed circuit board mounted proximate and parallel to one of said pair of panels; the first circuit board may also be used to mount the oscillator components and to connect the same to the first and second drive coils. Similarly, the first and second sense coils may be formed as matched spiral patterns of metal on a second printed circuit board mounted proximate and parallel to the other of said pair of panels, the first and second sense coils being of a size corresponding to that of the first and second drive coils; the second circuit board may also be used to mount the comparator components and to connect the same to the first and second sense coils.

The coin verification apparatus of the present invention may also include a gate member located near the exit of the predetermined path along which coins under test are guided. The gate member is movable between first and second positions for selectively directing the coin under test in a first direction or a second direction, respectively, to facilitate physical separation of coins which are verified as authentic from those which are not. A control circuit responsive to the comparator output signal actuates a solenoid to selectively move the gate member between its first and second positions. A sensor may be provided at a point beyond the gate member for generating a signal confirming that coins verified as authentic by the comparator have in fact been allowed to pass beyond the gate member.

DETAILED DESCRIPTION OF THE PREFERRED EMBODIMENT

Figure 1:
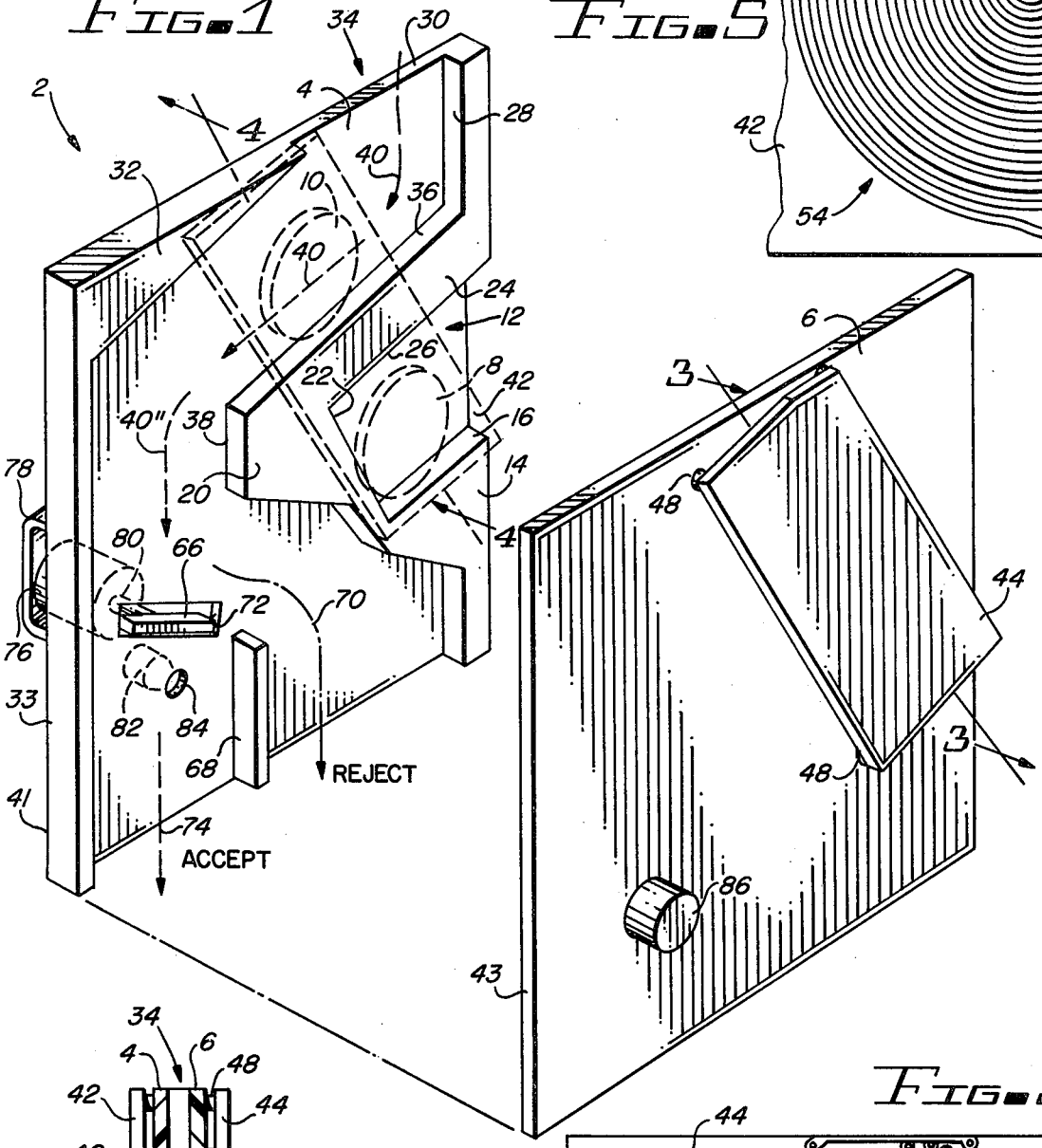
FIG. 1 is an exploded perspective view of the electronic coin verification apparatus illustrating a pocket wherein a reference coin is releasably retained and a ramp for guiding a coin under test along a predetermined path.
Figure 2:
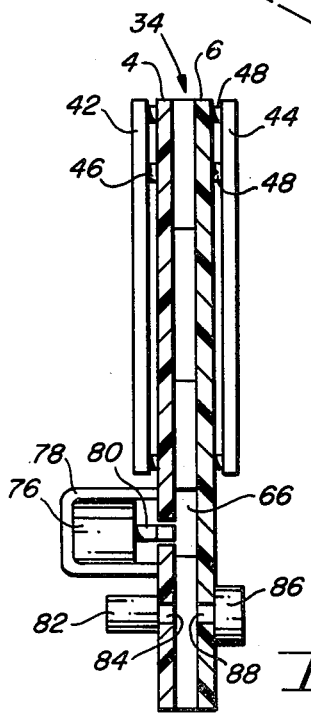
FIG. 2 is a cross-sectional view of the apparatus shown in FIG. 1 illustrating the relative placement of first and second printed circuit boards, a solenoid operated gate member, and a light source and photosensor.

Shown in FIG. 1 is an electronic coin verification apparatus constructed according to the teachings of the present invention and generally designated by reference numeral 2. Coin verification apparatus 2 includes a first panel 4 and a second panel 6. Referring briefly to FIG. 2, panels 4 and 6 are normally disposed parallel to one another and spaced apart by a distance in excess of the thickness of the thickest coin which is anticipated to be authenticated by the coin verification apparatus. For typical applications, it has been found satisfactory to space panels 4 and 6 apart from one another by a distance of approximately one-eighth of an inch.

Within FIG. 1, a reference coin is designated by dashed lines 8, and a coin under test is designated by dashed lines 10. The term "reference coin" will be understood by those skilled in the art as a coin of the type which the coin verification apparatus is to detect. For example, if the coin verification apparatus is installed within a video game designed to permit a player to operate the game upon depositing a quarter (twenty-five cent piece), then reference coin 8 is a quarter. On the other hand, if the video game is to be operated only upon the deposit of a token or a coin of some other denomination, then reference coin 8 is a corresponding token or coin of such other denomination, respectively.

Still referring to FIG. 1, a slot or pocket, designated generally by reference numeral 12, is formed between panels 4 and 6 for releasably retaining reference coin 8. As shown in FIG. 1, a member 14 is secured to the inner face of panel 4 and has a thickness approximately equal to the distance by which panels 4 and 6 are spaced apart. Member 14 includes a generally upward facing edge 16 which slopes at a downward angle from vertical edge 18 of panel 4. Another member 20, is also secured to the inner face of panel 4 and has a thickness substantially equal to that of member 14. Member 20 includes an edge 22 which intersects the lower end of edge 16 and extends at an upward angle therefrom approximately perpendicular thereto. The lengths of edges 16 and 22 are each slightly in excess of the diameter of the largest coin which is anticipated to be authenticated by the coin verification apparatus. A member 24, of thickness equal to that of members 14 and 20, is also secured to the inner face of panel 4 and includes a generally downwardly facing edge 26 which in the preferred embodiment of the present invention, extends substantially parallel to edge 16 of member 14. Edge 26 intersects the uppermost end of edge 22 and is accordingly spaced apart from edge 16 by a distance slightly in excess of the diameter of the largest coin to be inserted within pocket 12. Edges 16, 22, and 26, and the inner faces of panels 4 and 6, form pocket 12 and constitute a positioning means for releasably retaining reference coin 8 at a predetermined position at which the edges of reference coin 8 contact and are supported by edges 16 and 22. As shown in FIG. 1, members 14, 20 and 24 may be formed by a single continuous piece of material secured between panels 4 and 6. Coin verification apparatus 2 may be easily altered to authenticate coins of different types merely by temporarily tilting the apparatus to allow reference coin 8 to roll out of pocket 12 and subsequently inserting a new reference coin within pocket 12.

Still referring to FIG. 1, member 24 also includes a vertical edge 28 inset from edge 18 of panel 4 and extending substantially perpendicular to upper horizontal edge 30 of panel 4. Edge 28 extends downwardly from edge 30 of panel 4 by a distance slightly in excess of the diameter of the largest coin anticipated to be tested by coin verification apparatus 2. An additional member 32 is secured to the inner face of panel 4 adjacent upper edge 30 thereof and spaced apart from vertical edge 28 of member 24 by a distance slightly in excess of the diameter of the largest coin anticipated to be inserted within coin verification apparatus 2. Member 32, edge 28, and the inner faces of panels 4 and 6 thereby form an entrance slot 34 for receiving test coin 10. Member 24 further includes an edge 36 extending at a downward angle from the lowermost point of vertical edge 28. Edge 36 constitutes a positioning ramp forming a predetermined path along which test coin 10 may roll under the force of gravity in a substantially continuous motion. Member 20 includes a substantially vertically facing edge 38 extending downwardly from the lowermost point of ramping edge 36 for allowing test coin 10 to drop vertically from ramp 36. Thus, test coin 10 follows the predetermined path designated by the dashed arrows referenced by numerals 40, 40′ and 40″ within FIG. 1. Member 32 includes a vertically disposed portion 33 extending between and adjacent vertical edges 41 and 43 of panels 4 and 6, respectively, for preventing test coin 10 from escaping therethrough.

Referring jointly to FIGS. 1 and 2, first and second printed circuit boards 42 and 44, respectively, are secured parallel to and adjacent the outer faces of panels 4 and 6, respectively. In the preferred embodiment of the present invention, printed circuit boards 42 and 44 are secured to and spaced slightly apart from the outer faces of panels 4 and 6 by standoffs, designated by reference numerals 46 and 48, respectively. Standoffs 46 and 48 maintain the inner faces of printed circuit boards 42 and 44 approximately 0.450 inch to 0.500 inch apart from one another.

Figure 5:
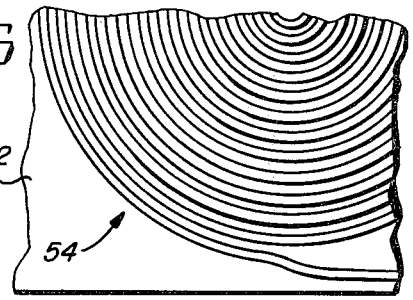
FIG. 5 is an enlarged view of the area enclosed within dashed circle 5 shown in FIG. 4 and illustrates with greater clarity a spiral metal pattern of the type formed upon a printed circuit board for providing one of the drive coils or sense coils.
Figure 3:
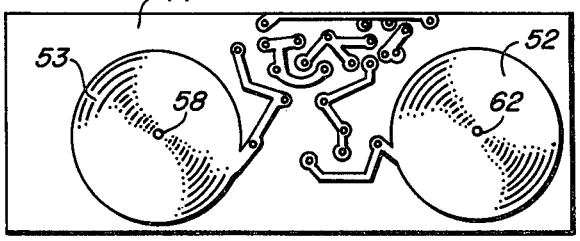
FIGS. 3 and 4 are views of first and second printed circuit boards, respectively, viewed through planes designated by lines 3—3 and lines 4—4 shown in FIG. 1, respectively, and illustrating the formation of first and second drive coils and first and second sense coils thereon.
Figure 4:
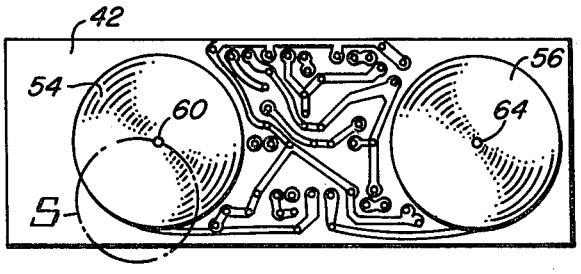

As shown in FIG. 3, the inner face of printed circuit board 44 has formed thereupon first and second drive coils 50 and 52, respectively. Similarly, with reference to FIG. 4, the inner face of printed circuit board 42 has formed thereupon first and second sense coils 54 and 56, respectively. With brief reference to FIG. 5, each of coils 50, 52, 54 and 56 is comprised by a spiraling pattern of conductive metal clad to the inner face of its respective printed circuit board. Accordingly, each of coils 50, 52, 54 and 56 is substantially planar. Moreover, the physical dimensions of first and second drive coils 50 and 52 are essentially identical to one another in size and shape for matching the electrical characteristics thereof. Similarly, the physical dimensions of sense coils 54 and 56 are also substantially identical for matching the electrical characteristics thereof. Such spiral patterns of conductive metal may easily be formed using conventional printed circuit board fabrication techniques. The center points 58, 60, 62 and 64 of coils 50, 54 52 and 56, respectively, are drilled and plated through to the opposite face of printed circuit boards 44 and 42 to facilitate electrical connection thereto.

Printed circuit boards 42 and 44 are mounted to the outer faces of panels 4 and 6 in the manner shown in FIGS. 1 and 2 whereby drive coil 50 extends substantially parallel to and concentric with sense coil 54. Similarly, drive coil 52 is disposed substantially parallel to and concentric with sense coil 56. Accordingly, drive coil 50 and sense coil 54 are inductively coupled to one another, and drive coil 52 and sense coil 56 are also inductively coupled to one another. Furthermore, drive coil 50 and sense coil 54 are disposed on opposite sides of pocket 12 and extend substantially parallel to the faces of reference coin 8. The concentric center points 58 and 60 of drive coil 50 and sense coil 54 are preferably disposed at an equal predetermined distance from supporting edges 16 and 22 of pocket 12 corresponding to the average radius of coins anticipated to be authenticated by the coin verification apparatus. Similarly, drive coil 52 and sense coil 56 extend substantially parallel to one another on opposite sides of the predetermined path along which test coin 10 passes as it falls through the coin verification apparatus. The concentric center points 62 and 64 of drive coil 52 and sense coil 56, respectively, are disposed at a distance normal to ramping edge 36 equal to the predetermined distance by which center points 58 and 60 of drive coil 50 and sense coil 54 are located from edges 16 and 22 of pocket 12.

As test coin 10 rolls along its edge down ramp 36, test coin 10 is temporarily positioned intermediate drive coil 52 and sense coil 56, the faces of test coin 10 being substantially parallel to drive coil 52 and sense coil 56. Assuming test coin 10 to be authentic, i.e., identical to reference coin 8, then test coin 10 will at least momentarily be positioned between drive coil 52 and sense coil 56 in a substantially identical manner as that in which reference coin 8 is disposed between drive coil 50 and sense coil 54. The manner in which drive coils 50 and 52 and sense coils 54 and 56 are utilized to compare test coin 10 to reference coin 8 is described in further detail below.

Still referring to FIGS. 1 and 2, a gate member 66 is shown, which gate member normally assumes a first position centered between panels 4 and 6. As shown best in FIG. 1, gate member 66 extends at an angle to the horizontal for tending to deflect test coin 10 to the right of a vertically extending divider or barrier 68, as designated by arrow 70. However, gate member 66 may also be retracted to a second position through a slot 72 within panel 4 to avoid interference with test coin 10, thereby allowing test coin 10 to fall vertically beyond gate member 66 to the left of vertical barrier 68, as designated by arrow 74. A solenoid 76 is secured to the outer face of panel 4 by a mounting bracket 78 and includes a movable plunger 80 normally biasing gate member 66 toward its first position for interfering with test coin 10. Upon actuation by an appropriate electrical signal, solenoid 76 causes plunger 80 to be retracted therein, thereby moving gate member 66 to its second position for avoiding interference with test coin 10. The manner in which solenoid 76 is controlled is described in further detail below.

Still referring to FIGS. 1 and 2, a sensor is also provided for creating a signal confirming that test coin 10 has in fact passed beyond gate member 66. A photosensor 82, such as a photosensitive transistor, is secured to the outer face of panel 4 immediately below slot 72, and a hole 84 is formed within panel 4 directly in front of sensor 82. A light source 86 is secured to the outer face of panel 6 directly opposite sensor 82, and a hole 88 (see FIG. 2) is formed within panel 6 for directing light emitted from light source 86 toward sensor 82. When gate member 66 is retracted to its second position and a test coin falls past slot 72, the test coin momentarily interrupts the passage of light from light source 86 to sensor 82, thereby providing a mechanism for verifying that test coin 10 has in fact passed beyond gate member 66. This feature of the present invention helps to prevent a person from retrieving test coin 10, by means of a thread or string secured thereto, from the coin verification apparatus after the test coin has been authenticated thereby. As will be described below, the signal created by sensor 82 may be used to release gate member 66 toward its first position for preventing the retrieval of test coin 10 through entrance slot 34.

Figure 6:
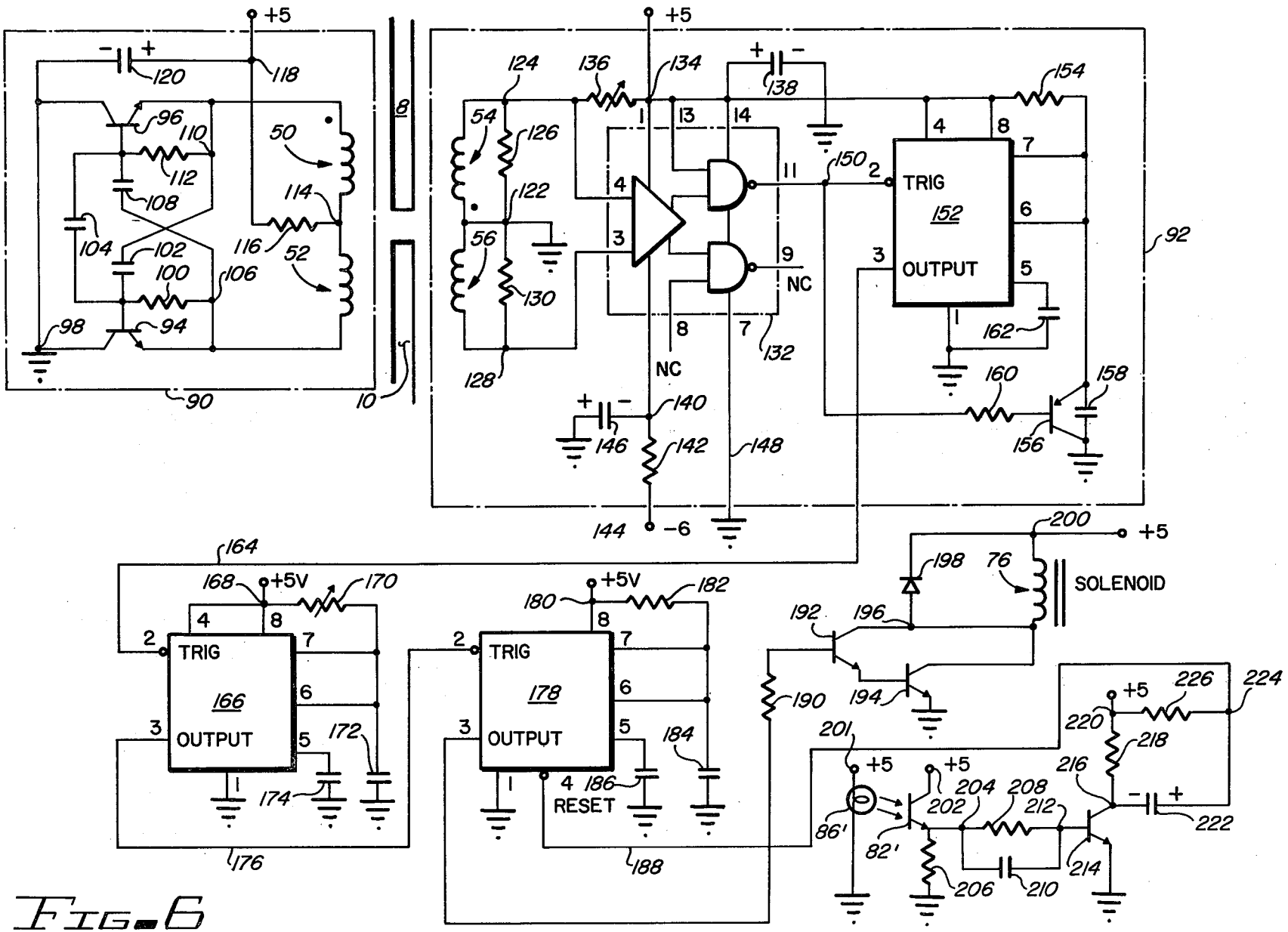
FIG. 6 is a circuit schematic of the oscillator circuitry used to drive the first and second drive coils and of the comparator circuitry coupled to the first and second sense coils, as well as control circuitry for controlling operation of the gate member solenoid.

Referring now to the circuit schematic shown in FIG. 6, the portion of the circuitry shown within dashed block 90 comprises an oscillator as well as drive coils 50 and 52. The portion of the circuit shown within dashed block 92 comprises a comparator circuit as well as sense coils 54 and 56. Reference coin 8 and test coin 10 are shown interposed between coils 50 and 54 and between coils 52 and 56, respectively. The remainder of the circuitry shown within FIG. 6 serves to control gate member solenoid 76 (see FIG. 1) and to respond to photosensor 82 (see FIG. 1) in a manner to be described below.

Referring to oscillator circuit 90, first and second transistors 94 and 96 each have their collector terminals commonly coupled to a source of ground potential 98. The base terminal of transistor 94 is coupled to a first end of resistor 100, the first end of capacitor 102, and the first end of capacitor 104. The second end of resistor 100 is coupled to node 106 which in turn is coupled to the emitter of transistor 94, to a first end of capacitor 108, and to a first end of drive coil 52. The second end of capacitor 102 is coupled to node 110 which in turn is coupled to the emitter of transistor 96, to a first end of resistor 112, and to a first end of drive coil 50. The second end of capacitor 104 is coupled to the base of transistor 96, to the second end of capacitor 108 and to the second end of resistor 112. The second ends of drive coils 50 and 52 are coupled to one another at node 114. Resistor 116 extends between node 114 and positive supply voltage terminal 118 which is coupled to a positive five volt D.C. supply in the preferred embodiment of the present invention. Filter capacitor 120 extends between positive supply voltage terminal 118 and ground terminal 98. Transistors 94 and 96, resistors 100 and 112, and capacitors 102 and 108 are each matched to one another for causing the voltages produced at nodes 106 and 110 to be symmetrical to one another and of equal magnitudes. The voltages imposed across drive coils 50 and 52 are 180° out of phase with one another. The values of the components within oscillator circuit 90 are chosen to provide substantially sinusoidal oscillating waveforms at nodes 106 and 110 with a frequency of approximately 600 kilocycles. Such oscillating voltages are imposed across drive coils 50 and 52 for creating electromagnetic fields adjacent thereto. The electromagnetic fields created by drive coils 50 and 52 are substantially equal in magnitude. In the preferred embodiment of the present invention, transistors 94 and 96, capacitors 102, 104, 108, and 120, and resistors 100, 112 and 116, are all mounted to and interconnected by printed circuit board 44.

The size, configuration, and metallic content of reference coin 8 determine the extent of inductive coupling from drive coil 50 to sense coil 54 within comparator circuitry 92. Similarly, at the moment at which test coin 10 is precisely intermediate drive coil 52 and sense coil 56, the size, configuration, and metallic content of test coin 10 determine the extent of inductive coupling between drive coil 52 and sense coil 56. As shown in FIG. 6, sense coil 54 is wound in an opposite direction from drive coil 50 while sense coil 56 is wound in the same direction as drive coil 52. Accordingly, the phase reversal of the voltages conducted by drive coils 50 and 52 is compensated for by sense coils 54 and 56.

Sense coils 54 and 56 each have an end commonly coupled to node 122 which is in turn coupled to a source of ground potential. A second end of sense coil 54 is coupled to node 124. Node 124 is in turn coupled by a resistor 126 to node 122. Similarly, a second end of sense coil 56 is coupled to node 128 which is in turn coupled by a resistor 130 to node 122. Resistors 126 and 130 are matched to avoid introducing an offset to the voltages provided by sense coils 54 and 56.

Included within comparator circuit 92 is a differential amplifier integrated circuit designated by dashed block 132. Differential amplifier 132 may be of the type commercially available from National Semiconductor Corporation under model designation LM361. Input pins 4 and 3 of integrated circuit 132 are coupled to nodes 124 and 128, respectively, for receiving the ground referenced voltages inductively coupled into sense coils 54 and 56. Pins 13 and 14 of integrated circuit 132 are each coupled to node 134 which is in turn coupled to a source of a positive supply voltage, or a positive 5 volts D.C. supply in the preferred embodiment of the invention. In addition, variable offset resistor 136 is coupled between node 134 and input pin 4 of integrated circuit 132. The function of resistor 136 is largely to compensate for any offset exhibited by the differential inputs of integrated circuit 132 and for offset introduced by mismatch of sense coils 54 and 56 and resistors 126 and 130. Furthermore, resistor 136 is selected to cause integrated circuit 132 to prefer one output state over the other output state when sense coils 54 and 56 provide voltage signals substantially equal in magnitude. A filter capacitor 138 extends between positive supply voltage node 134 and a source of ground voltage. Pin 6 of integrated circuit 132 is coupled to node 140 which in turn is coupled through resistor 142 to negative supply voltage terminal 144 and through a filter capacitor 146 to a source of ground voltage. In the preferred embodiment of the present invention, negative voltage supply terminal 144 is coupled to a source of negative 6 volts D.C. Pin 7 of integrated circuit 132 is coupled by conductor 148 to a source of ground voltage. Pins 8 and 9 of integrated circuit 132 are left unconnected. Pin 11 of integrated circuit 132 serves as the output terminal and is coupled to node 150 for providing an output signal in a manner now to be described.

Integrated circuit 132 amplifies the difference of the voltage signals received at input pins 4 and 3 from sense coils 54 and 56 and generates a digital TTL output voltage level at output node 150 in response thereto. As used herein, a "low level" refers to a voltage level at or near ground potential, while a "high level" refers to a voltage level at or near the positive supply voltage. Assuming that test coin 10 is not directly between drive coil 52 and sense coil 56, or assuming that test coin 10 is between coils 52 and 56 but is not of the same type as reference coin 8, then the voltage signal provided to input pin 4 will not match that provided to input pin 3. As the relative polarity across input pins 3 and 4 constantly changes at the frequency at which oscillator 90 is turned, the output signal generated at node 150 will switch states between low and high levels at the same frequency as that of oscillator 90. However, assuming that test coin 10 is of the same type as reference coin 8, then for the brief interval that test coin 10 is directly between drive coil 52 and sense coil 56, the input signals received by pins 3 and 4 of integrated circuit are substantially equal in phase and magnitude. In this event, output pin 11 of integrated circuit 132 assumes a steady high level due to the preference created by offset resistor 136. It has been found that the steady high level need only be maintaincd for approximately 6 milliseconds for the coin verification apparatus to work properly. Referring briefly to FIG. 1, the angle of ramp edge 36 relative to the vertical can be adjusted for ensuring that the high level generated at output node 150 has a duration of at least 6 milliseconds without unduly limiting the rate at which coins may be fed into the coin verification apparatus. For example, it has been found that the ramp edge 36 may be as steep as 15° to the vertical and still permit the coin verification apparatus shown in FIG. 1 to operate satisfactorily.

Comparator circuit 92 further includes an integrated circuit monostable multivibrator designated by reference numeral 152. Integrated circuit 152 may be of the type commercially available from Signetics Corporation under model designation NE555. Pins 4 and 8 of integrated circuit 152 are coupled to positive supply voltage terminal 134. Pins 6 and 7 of integrated circuit 152 are coupled through resistor 154 to positive supply voltage terminal 134. In addition, pins 6 and 7 of integrated circuit 152 are coupled to the emitter of transistor 156 and to a first end of capacitor 158. The collector of transistor 156 and the second end of capacitor 158 are each coupled to a source of ground voltage. The base terminal of transistor 156 is coupled through resistor 160 to output node 150 and to negative edge triggered input pin 2 of integrated circuit 152. Pin 1 of integrated circuit 152 is coupled to a source of ground voltage, and pin 5 of integrated circuit 152 is coupled through capacitor 162 to the source of ground voltage. Pin 3 of integrated circuit 152 serves as an output terminal for creating a high level pulse of a predetermined duration whenever integrated circuit 132 produces a negative edge trigger pulse. Transistor 156 and resistor 160 serve to render integrated circuit 152 retriggerable by discharging capacitor 158 each time the voltage at node 150 switches to a low level; thus, each negative going pulse received by input pin 2 causes the voltage at output pin 3 to assume the high level for the predetermined duration following receipt of each such negative going pulse. Integrated circuit 152 is configured to time out a delay slightly in excess of the frequency of oscillator 90 whereby integrated circuit 152 is continuously retriggered during normal operations. Only when integrated circuit 132 indicates that test coin 10 is authentic and thereby causes output node 150 to remain at a high level for a relatively long duration, does integrated circuit 152 time out and allow output pin 3 to assume a low level. In the preferred embodiment of the present invention, all of the components enclosed by dashed lines 92 in FIG. 6 are mounted upon and interconnected by printed circuit board 42.

Still referring to FIG. 6, output pin 3 of integrated circuit 152 is coupled by conductor 164 to the negative edge trigger input pin 2 of a further monostable multivibrator integrated circuit 166. Monostable multivibrator integrated circuit 166 may also be of the type commercially available from Signetics Corporation under model designation NE555. Pins 4 and 8 of integrated circuit 166 are coupled directly to positive supply voltage terminal 168. In addition, pins 6 and 7 are coupled by variable resistor 170 to positive supply terminal 168 and are coupled by capacitor 172 to a source of ground voltage. Pin 1 of integrated circuit 166 is coupled directly to a source of ground voltage, and pin 5 is coupled through capacitor 174 to a source of ground voltage. Output pins 3 of integrated circuit 166 provides a positive going pulse of a predetermined duration each time trigger pin 2 receives a negative going edge. However, whereas the steady high level provided by pin 3 of integrated circuit 152 may last for less than 6 milliseconds, the high level pulse provided by output pin 3 of integrated circuit 166 may be of relatively any desired duration. In the preferred embodiment of the present invention, the value of resistor 170 and of capacitor 172 associated with integrated circuit 166 are selected to provide a high level pulse of a duration related to the time required for test coin 10 to pass from a point intermediate drive coil 52 and sense coil 56 to a point just above gate member 66 (see FIG. 1).

Referring again to FIG. 1, were sensor 82 and light source 86 omitted from the coin verification apparatus, then output pin 3 of integrated circuit 166 would be used to directly control drive circuitry coupled to solenoid 76. In this event, the duration of the high level pulse provided at output pin 3 of integrated circuit 166 would be made somewhat longer to be in excess of the time required for test coin 10 to pass from between coils 52 and 56 to a point below gate member 66 (see FIG. 1). However, as mentioned above, it may be desired to verify that the test coin has actually been allowed to pass beyond gate member 66 prior to deactuating the solenoid and prior to allowing the user to operate the machine in which the coin verification apparatus is installed. In this event, as shown in FIG. 6, output pin 3 of integrated circuit 166 is coupled by conductor 176 to the negative edge triggered input pin 2 of a further monostable multivibrator integrated circuit 178. Integrated circuit 178 may also be of the type commercially available from Signetics Corporation under the model designation NE555. Pin 8 of integrated circuit 178 is directly coupled to positive supply voltage node 180. Pins 6 and 7 of integrated circuit 178 are coupled by resistor 182 to positive supply node 180 and by capacitor 184 to a source of ground voltage. Pin 1 is coupled directly to the source of ground voltage, while pin 5 is coupled through capacitor 186 to the source of ground voltage. Negative edge triggered reset pin 4 of integrated circuit 178 is coupled to conductor 188 for a purpose to be described in further detail below.

Assuming that differential amplifier integrated circuit 132 detects that test coin 10 is authentic, integrated circuit 152 times out and triggers integrated circuit 166 which in turn provides a high level pulse having a duration slightly less than the time required for test coin 10 to reach gate member 66. Integrated cricuit 166 then times out and allows the voltage on output pin 3 thereof to switch to a low level. The negative going edge provided at output pin 3 of integrated circuit 166 then triggers integrated circuit 178 and causes output pin 3 thereof to switch to a high level for a predetermined duration. Output pin 3 of integrated circuit 178 is coupled by resistor 190 to the base of transistor 192. Transistors 192 and 194 are interconnected in a Darlington-coupled configuration. The emitter of transistor 192 is coupled to the base of transistor 194, and the emitter of transistor 194 is coupled to a source of ground voltage. The collectors of Darlington-coupled transistors 192 and 194 are each coupled to node 196. Node 196 is coupled to the anode of diode 198 and to a first end of solenoid coil 76. The cathode of diode 198 and the second end of solenoid coil 76 are each coupled to positive supply voltage node 200. Diode 198 suppresses large transient positive voltages upon node 196.

Upon output pin 3 of integrated circuit 178 assuming a high level, biasing current is supplied through resistor 190 to the base of transistor 192, rendering Darlington-coupled transistors 192 and 194 conductive for energizing solenoid coil 76 and retracting gate member 66 to its second position for allowing test coin 10 to fall to the left of barrier 68. The duration of the positive going pulse provided by output pin 3 is selected to be in excess of the time required for test coin 10 to pass beyond photosensor 82 (see FIG. 1).

Still referring to FIG. 6, low voltage incandescent light bulb 86' is coupled between positive supply voltage terminal 201 and a source of ground voltage and corresponds to light source 86 shown in FIGS. 1 and 2. Light emitted from incandescent light bulb 86' is directed toward phototransistor 82' for normally rendering the same conductive. The collector terminal of phototransistor 82' is coupled to positive supply voltage terminal 202, and the emitter of transistor 82' is coupled to node 204. Node 204 is coupled through resistor 206 to a source of ground voltage. Resistor 208 and capacitor 210 are coupled in parallel between node 204 and node 212. Transistor 214 has its base terminal coupled to node 212, its emitter terminal coupled to a source of ground voltage, and its collector terminal coupled to node 216. Resistor 218 extends between node 216 and positive supply voltage terminal 220. Node 216 is also coupled to a first end of capacitor 222, the second end of which is coupled to node 224. Resistor 226 extends between node 224 and positive supply voltage terminal 220. Node 224 is also coupled by conductor 188 to reset pin 4 of integrated circuit 178.

During normal operating conditions, phototransistor 82' is rendered conductive by light emitted from light bulb 86'; accordingly, the voltage at node 204 is typically at a high level, or approximately +5 volts. The base terminal of transistor 214 receives biasing current through resistor 208 and is also normally conductive. Node 212 is one base-emitter voltage drop above ground potential. Thus, the voltage stored across capacitor 210 is approximately 4 volts. Transistor 214 is normally saturated whereby the collector voltage at node 216 is approximately equal to ground potential. Resistor 226 charges capacitor 222 until the voltage at node 224 is approximately equal to +5 volts, and accordingly line 188 is normally at a high voltage level.

However, when test coin 10 temporarily falls between light bulb 86' and phototransistor 82', phototransistor 82' is temporarily rendered non-conductive, and node 204 quickly falls toward ground potential. Node 212 is forced to a voltage below that of ground potential due to the charge stored across capacitor 210. Accordingly, transistor 214 is rendered non-conductive and node 216 rises toward the positive supply voltage. Since the voltage across capacitor 222 can not change instantaneously, the voltage on node 224 initially rises toward +10 volts and decays back toward +5 volts as capacitor 222 is discharged.

As soon as test coin 10 falls beyond phototransistor 82', light emitted from light bulb 86' once again strikes phototransistor 82' and renders it conductive. Node 204 quickly rises toward +5 volts, and capacitor 210 pumps charge into the base of transistor 214 for rapidly causing transistor 214 to become conductive. Thus, node 216 rapidly falls toward ground voltage. Since the voltage across capacitor 222 can not change instantaneously, node 224 also falls toward ground voltage and charges up toward +5 volts. The rapid negative transition at node 224 toward ground voltage is effective to reset integrated circuit 178 and to consequently force output pin 3 thereof back to a low level for deenergizing solenoid 76.

The overall operation of the coin verification apparatus shown schematically in FIG. 6 will now be summarized below. As described above, at all times other than when a test coin 10 matching reference coin 8 is intermediate drive coil 52 and sense coil 56, the signals inductively coupled to sense coils 54 and 56 are imbalanced, and comparator 132 produces a square wave at node 150 having TTL output levels and having a frequency equal to that of the oscillator 90. Integrated circuit 152 is constantly retriggered by the continuous square wave produced at node 150 causing its output pin 3 to remain at a high level. The time delay provided by integrated circuit 152 is longer than the period of oscillator 90 but substantially shorter than 6 milliseconds. Transistor 156 and resistor 160 are used in conjunction with integrated circuit 152 to render the same retriggerable. Since output pin 3 of integrated circuit 152 remains at a high level, integrated circuit 166 is not triggered, and its output pin 3 remains at a low level. Accordingly, integrated circuit 178 is not triggered and its output pin 3 also remains at a low level. The low level at output pin 3 of integrated circuit 178 maintains Darlington-coupled transistors 192 and 194 non-conductive, and accordingly no current flows through solenoid coil 76. Therefore, gate member 66 is biased toward its first position for deflecting coins to the right of barrier 68 (see FIG. 1). Also, since light emitted from light bulb 86' strikes phototransistor 86', transistor 214 is rendered conductive, node 224 is pulled to a high level by resistor 226, and reset input 4 of integrated circuit 178 is at a non-active high level.

Now, assuming that a test coin 10 matching reference coin 8 is deposited within the coin verification apparatus, test coin 10 ultimately passes between drive coil 52 and sense coil 56 and inductively couples a signal to sense coil 56 substantially matching the signal inductively coupled to sense coil 54 by reference coin 8. For at least 6 milliseconds, the signals received at input pins 3 and 4 of comparator 132 are substantially equal, causing node 150 to remain at a high level for at least 6 milliseconds. Accordingly, integrated circuit 152 fails to receive a negative triggering edge prior to timing out its normal delay period, and output pin 3 of integrated circuit 152 switches to a low level. The negative going edge produced at output pin 3 of integrated circuit 152 thereafter triggers integrated circuit 166, and output pin 3 of integrated circuit 166 then switches to a high level.

Once test coin 10 passes beyond drive coil 52 and sense coil 56, the inputs of comparator 132 will again be imbalanced, and the continuous high level previously provided to node 150 will once again switch between low and high levels at the frequency of oscillator 90. Therefore, pin 3 of integrated circuit 152 will return to a continuous high level. Nonetheless, integrated circuit 166, having already been triggered, will continue to maintain its output pin 3 at a high level until it has timed out. The values of the resistive and capacitive components associated with integrated circuit 166 are chosen such that the delay provided by integrated circuit 166 corresponds substantially to the time required for test coin 10 to travel from a position intermediate drive coil 52 and sense coil 56 to a position immediately above gate member 66. When such a delay has been timed out, output pin 3 will return to a low level, thereby triggering integrated circuit 178 and causing output pin 3 thereof to switch to a high level. The high level at output pin 3 of integrated circuit 178 renders Darlington-coupled transistors 192 and 194 conductive for energizing solenoid coil 76 and retracting gate member 66 for allowing test coin 10 to fall to the left of barrier 68 (see FIG. 1). The delay provided by integrated circuit 178 is significantly longer than the time normally required for test coin 10 to pass from a position immediately above gate member 66 to a position below photosensor 82. Upon the test coin passing between light bulb 86' and phototransistor 82' and thereafter falling past such components, a low level pulse is provided at node 224 for causing integrated circuit 178 to reset prior to being timed out, thereby deenergizing solenoid coil 76 immediately upon detecting that test coin 10 has fallen below gate member 166.

Values and device types of components shown in FIG. 6 as used within a particularly advantageous embodiment of the present are indicated in the table below:

| Component | Value/Type |
|---|---|
| T94, T96 | 2N2222 |
| R100, R112 | 1 K Ω |
| C102, C108 | .01 μfd |
| C104 | .1 μfd |
| R116 | 100 Ω |
| C120 | 1 μfd |
| R126, R130 | 51 Ω |
| R136 | 50 K Ω pot |
| C138 | 1 μfd |
| R142 | 100 Ω |
| C146 | 1 μfd |
| R154 | 220 K Ω |
| T156 | 2N4403 |
| C158 | .01 μfd |
| R160 | 100 Ω |
| C162 | .01 μfd |
| R170 | 100 K Ω pot |
| C172 | 1 μfd |
| C174 | .01 μfd |
| R182 | 100 K Ω |
| C184 | 1 μfd |
| C186 | .01 μfd |
| R190 | 1 K Ω |
| T192, T194 | 2N2222 |
| D198 | 1N4001 |
| T82' | FPT 100 |
| R208 | 5.1 K Ω |
| C210 | .1 μfd |
| T214 | 2N2222 |
| R218 | 1 K Ω |
| C222 | 1 μfd |
| R226 | 5.1 K Ω |

Those skilled in the art will now appreciate that an electronic coin verification mechanism has been described which is relatively inexpensive to construct and which may be formed as a compact structure suitable for use within table-top electronic games as well as in larger structures such as vending machines. The described apparatus will accept test coins virtually as fast as one can feed them into the apparatus and can be altered to test for various different types of coins merely by replacing a first reference coin with a second reference coin of a different type. While the invention has been described with reference to a preferred embodiment thereof, the description is for illustrative purposes only and is not to be construed as limiting the scope of the invention. For example, in machines wherein rejected coins are retained along with accepted coins, rather than being returned to the user, gate member 66 and solenoid 76 may be eliminated, and the low level pulse provided by integrated circuit 152 may be used as the output signal indicating that an authentic coin has been inserted into the machine, thereby significantly simplifying the apparatus by eliminating integrated circuits 166 and 178 and their associated components. Various other modifications and changes may be made by those skilled in the art without departing from the true spirit and scope of the invention as defined by the appended claims.

We claim:

1. An apparatus for verifying the authenticity of a coin under test, said apparatus comprising in combination:

a. retaining means for releasably retaining a reference coin;

b. guide means for guiding a coin under test along a predetermined path;

c. first and second matched drive coil, said first drive coil being disposed adjacent to one side of said retaining means, and said second drive coil being disposed adjacent to one side of said predetermined path;

d. an oscillator coupled to said first and second drive coils for applying a first generally sinusoidal voltage to said first drive coil and a second generally sinusoidal voltage to said second drive coil, said first and second generally sinusoidal voltages being substantially equal in magnitude.

e. first and second matched sense coils inductively coupled to said first and second drive coils, respectively, said first sense coil being disposed adjacent to said retaining means on a side thereof opposite said first drive coil, and said second sense coil being disposed adjacent to said predetermined path on a side thereof opposite said second drive coil; and f. a comparator coupled to said first and second sense coils for comparing the voltages inductively coupled to said first and second sense coils and generating an output signal when the voltages inductively coupled to said first and second sense coils are substantially equal for indicating the authenticity of the coin under test, said comparator including a differential amplifier having first and second inputs coupled to said first and second sense coils, respectively, said differential amplifier having an output terminal for providing a first signal when the voltages inductively coupled to said first and second sense coils are not substantially equal and providing a second signal when the voltages inductively coupled to said first and second sense coils are substantially equal, said comparator also including a first retriggerable monostable multivibrator having a trigger input coupled to the output terminal of said differential amplifier, said first retriggerable monostable multivibrator being continuously triggered by said first signal provided by said differential amplifier and said first retriggerable monostable multivibrator not being triggered by said second signal provided by said differential amplifier, said first retriggerable monostable multivibrator including an output terminal for generating said output signal of said comparator as a first output level when said first retriggerable monostable multivibrator has been triggered and as a second output level when said first retriggerable monostable multivibrator has not been triggered, said second output level indicating that the coin under test is authentic.

2. An apparatus as recited by claim 1 including a second monostable multivibrator having a trigger input coupled to the output terminal of said first retriggerable monostable multivibrator and having an output terminal, said output terminal of said second monostable multivibrator providing an output signal of a predetermined duration each time a coin under test is verified to be authentic.

* * * * *